US005584246A

United States Patent [19]

Steffen et al.

[11] Patent Number: 5,584,246

[45] Date of Patent: Dec. 17, 1996

[54] PROCESS AND APPARATUS FOR PRINTING ON FLAT INDIVIDUAL ARTICLES

[75] Inventors: Volker Steffen, Herford; Horst Heidenreich, Kirchlengern; Norbert Rohwetter, Bünde, all of Germany

[73] Assignee: Werner Kammann Maschinenfabrik GmbH, Bünde, Germany

[21] Appl. No.: 558,102

[22] Filed: Nov. 15, 1995

[30] Foreign Application Priority Data

Jun. 9, 1995 [DE] Germany ..... 195 21 039.5
Sep. 20, 1995 [DE] Germany ..... 195 34 827.3

[51] Int. Cl.[6] ..... B41F 13/24

[52] U.S. Cl. ..... 101/485; 101/181; 101/211; 101/232; 101/233; 101/216

[58] Field of Search ..... 101/485, 486, 101/DIG. 30, 136, 181, 211, 232, 233, 216, 219

[56] References Cited

U.S. PATENT DOCUMENTS

| | | | |
|---|---|---|---|
| 2,208,045 | 7/1940 | Durup et al. | 101/485 |
| 2,389,891 | 11/1945 | Budden et al. | 101/485 |
| 3,835,776 | 8/1974 | Weidman | 101/232 |
| 4,825,762 | 5/1989 | Fischer | 101/232 |
| 5,287,809 | 2/1994 | Greive | 101/485 |
| 5,370,047 | 12/1994 | Compton | 101/216 |
| 5,419,256 | 5/1995 | Pollich | 101/485 |
| 5,423,255 | 6/1995 | Maass | 101/232 |
| 5,463,953 | 11/1995 | Kaspers et al. | 101/485 |
| 5,477,780 | 12/1995 | Keller | 101/137 |
| 5,481,970 | 1/1996 | Terzi et al. | 101/232 |

*Primary Examiner*—Eugene H. Eickholt
*Attorney, Agent, or Firm*—Panitch Schwarze Jacobs & Nadel, P.C.

[57] ABSTRACT

In a process and apparatus for printing on flat individual articles such as cards by means of offset printing, the article, before being moved into a starting position for the printing operation, is firstly aligned relative to the printing cylinder. While the article is maintained in the aligned position by suction force, the article is then transferred on to a holding device and into the starting position for the printing operation. The holding device with article is then moved in a first direction relative to the printing cylinder for transfer of the print image therefrom on to that article. The holding device then moves in a second direction opposite to the first direction. During that movement the article with print image thereon is displaced relative to the holding device on which it is supported, to provide space on the holding device for the article to be printed upon in the following working cycle.

49 Claims, 10 Drawing Sheets

FIG.3
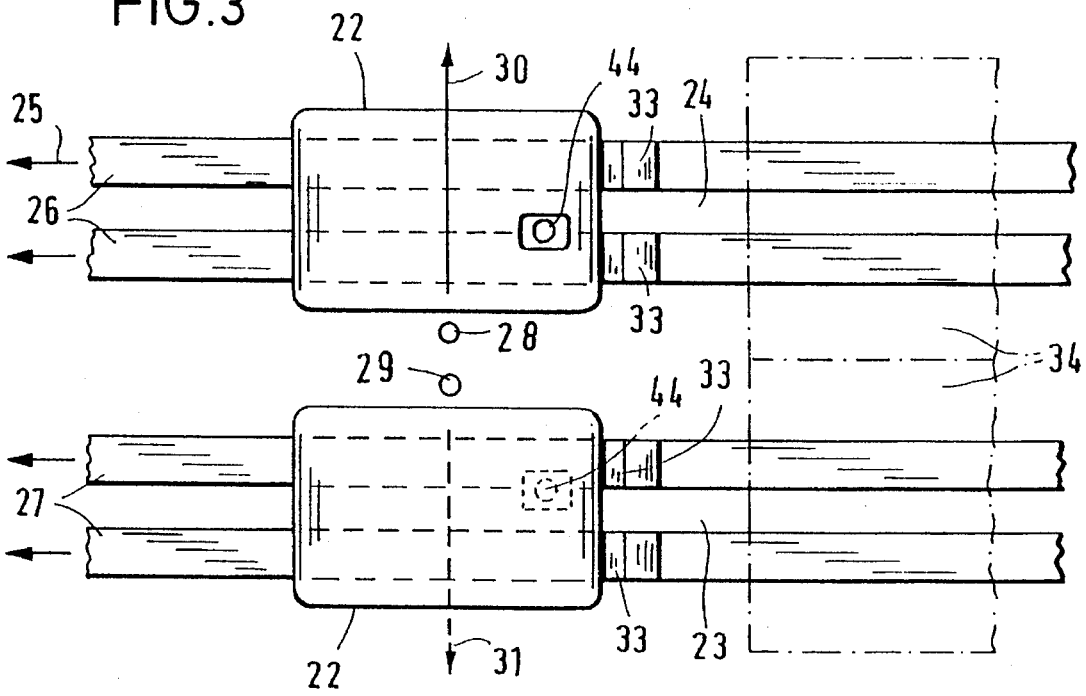
FIG.4
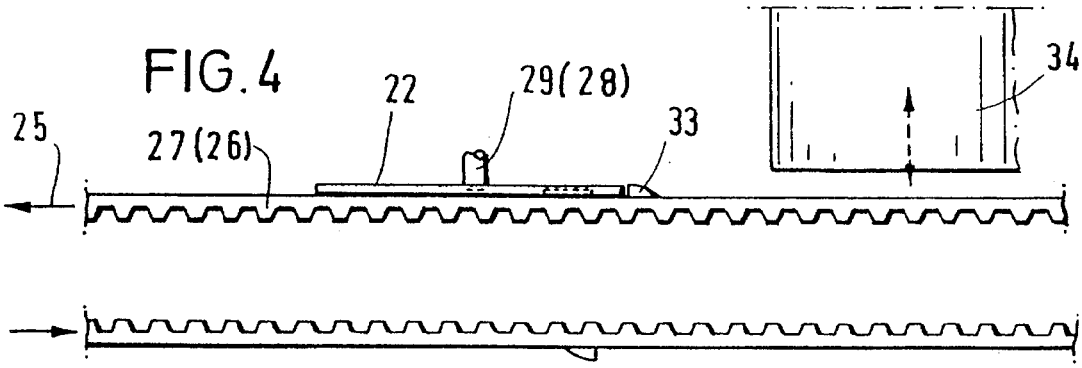
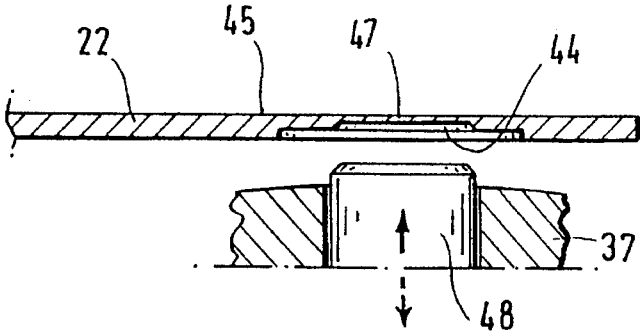
FIG.5

PROCESS AND APPARATUS FOR PRINTING ON FLAT INDIVIDUAL ARTICLES

FIELD OF THE INVENTION

The present invention concerns a process and an apparatus for printing at least once on flat individual articles.

It will be noted in this respect here that such articles are primarily those whose extent in the plane of the surface to which printing is to be applied is substantially greater than in the transverse direction thereto. Examples of such articles that may be mentioned here are credit cards, telephone cards, control cards and the like, which are predominantly provided with the substantially flat surfaces. Cards of that kind are generally of a thickness of for example 0.6 m.

BACKGROUND OF THE INVENTION

Printing is to be applied to those articles using an offset printing process, although it is not impossible for other printing processes, for example screen printing, additionally to be used. The offset printing process, by virtue of the use of a print configuration or pattern with a high degree of resolution, makes it possible to apply print images with a high level of detail fidelity in a large number of colors and intermediate tones, with the result that the number of colors and color shades in the finished print image can go far beyond the number of basic printing inks used for producing the print image.

Attention is directed in this respect to U.S. Pat. application Ser. No. 08/176,554 (U.S. Pat. No. 5,456,169) describing processes and apparatuses for printing on flat individual articles and more especially CDs. That process and apparatus involve the use of a rotary table which is provided adjacent its periphery with a very large number of holders, a CD being fitted into each of those holders. That process is highly advantageous in terms of applying printing to CDs, but the apparatus which is used for carrying that process into effect is directed in a specific manner to the requirements that arise in regard to printing on CDs. Those requirements however do not arise in regard to the usual forms of cards as are used as telephone cards, credit cards and the like, for the simple reason that cards of that kind are of substantially lower weight than CDs and are therefore lighter and easier to handle than the latter. Added to this is the fact that the frequently regular rectangular shape of such cards also facilitates handling thereof.

SUMMARY OF THE INVENTION

An object of the present invention is to provide a process for printing on individual articles in such a way as to ensure a high degree of operating reliability with a high throughput rate using an offset printing procedure.

Another object of the present invention is to provide a process for printing on individual flat articles whose extent perpendicularly to at least one Surface thereof to be printed upon is relatively small, which affords a high output and highly accurate printing results, even when the articles in question are for example cards having at least one opening serving for example to accommodate a chip.

Still another object of the present invention is to provide an apparatus for printing on individual articles whose extent in the plane of a surface to be printed upon is substantially greater in the transverse direction thereto, which gives high-resolution printing results with a high degree of accuracy and at a high rate.

Still a further object of the present invention is to provide an apparatus for printing on flat individual articles such as cards which is of such a design configuration that it can be rapidly converted from one card format to another.

In accordance with the principles of the present invention, in terms of the process the foregoing and other objects are achieved by a process for printing on individual articles having at least one surface to be printed upon, the extent of the article perpendicularly to said at least one surface being generally relatively small. The process uses at least one offset printing arrangement with at least two plate cylinders and a printing or blanket cylinder provided at its periphery with at least one transfer means on to which the partial print images are transferred. The overall print image formed from at least two partial print images is transferred from the transfer means on to the article to be printed upon. Prior to transfer into the starting position for the printing operation, the said article to be printed upon is firstly oriented in an aligning device relative to the transfer means of the printing cylinder and then, while the aligned position is maintained, the article is moved by a transfer device on to a holding device and into the starting position for the printing operation. The holding device with the article is then moved in a first direction relative to the printing cylinder at a speed corresponding to the peripheral speed of the transfer means in order to transfer the print image from the transfer means on to the article which is in direct contact therewith.

Further in accordance with the present invention, in regard to the apparatus the foregoing and other objects are attained by an apparatus for printing on individual articles whose extent perpendicularly to a substantially flat surface thereof which is to be printed upon is generally relatively small, the apparatus comprising at least one offset printing arrangement and at least first and second transport means which are arranged in succession in the direction of transport of the articles through the apparatus, and at least one holding means for holding an article to be printed upon during a printing operation. The offset printing arrangement has at least first and second plate cylinders and a blanket or printing cylinder which at its periphery has at least one transfer means with at least one transfer surface for an overall print image formed from at least two partial print images. The holding means is arranged reciprocally between a first position in which it receives a said article to be printed upon and a second position at a spacing from said first position. An aligning means is arranged upstream of the holding means in said transport direction. The apparatus further includes a transfer means for transfer of the articles, which is arranged reciprocally between the aligning means and the holding means in the receiving position.

As will be seen in greater detail from a description hereinafter of a preferred embodiment of the apparatus according to the invention, a holding means for an article to be printed upon is associated with the printing cylinder of the offset printing arrangement. The holding means which is preferably in the form of a printing table performs reciprocating, preferably linear movements, wherein during the movement in one direction printing is applied to the article while in the movement in the opposite direction the article is displaced relative to the holding means into a second position. By virtue of that displacement which takes place in the transport direction relative to the printing table, on the one hand the printing table is released for receiving the article to be printed upon in the following working cycle. On the other hand, that displacement is at the same time the first transport step following the printing operation.

It will be seen hereinafter that in a particularly simple fashion that displacement of the article on the printing table can be produced by means of an abutment or stop which projects into the path of movement of the article so that the movement of the printing table is utilized for displacing the article relative thereto. That permits a simple neat design configuration to be adopted for the holding means which carries the article during the printing operation and on which the subsequent article-transport step also takes place at the same time. As that design configuration of the apparatus only requires one holding means to be provided, the apparatus is not only uncomplicated but it is also less expensive. The possibility of using only one holding means also makes a considerable contribution to the fact that the time required for a change in format, as when converting the apparatus from one card series to another, can be very short as, apart naturally from the alterations required on the actual printing mechanism in a situation where a different print image is to be applied to the subsequent card series, it is only necessary to change the holding means when the format, that is to say for example the dimensions of the article and/or the provision of an opening in the article, changes when switching over from one card series to another. The relatively simple structure of the holding means also advantageously contributes to fault-free operation of the apparatus at a high production rate. The production rate can if necessary be further increased by the apparatus being so designed that it can simultaneously print on two or possibly even more articles. To achieve that, it is only necessary for the holding means to be of such a dimension in terms of its width that to or even more articles have sufficient space to be accommodated in juxtaposed relationship on the holding means, with the printing mechanism also being of such a design configuration that it can simultaneously transfer a number of print images, corresponding to the number of articles on the holding means. In essence this will mean that the printing cylinder and the transfer means thereon for the print images as well as the associated components, that is to say more particularly the plate cylinders, are of a suitably sized extent parallel to the axis of rotation of the printing cylinder.

An apparatus for applying printing to two articles in pairs has proven to be particularly desirable as, if printing is to be applied to both sides of the generally flat article, printing can be applied to one side of the article in the first passage thereof through the apparatus while printing can be applied to the other side of the article in the second passage through the apparatus, the transfer means on the printing cylinder for the print images respectively receiving and transferring two different print images when printing of different kinds is to be applied to the two sides of each article.

Further objects, features and advantages of the present invention will be apparent from the following description of a preferred embodiment.

BRIEF DESCRIPTION OF THE DRAWINGS

FIG. 3 is a view on an enlarged scale of the region identified by 3 in FIG. 2, FIG. 4 is a side view of the region shown in FIG. 3, FIG. 5 shows a portion of a card with a cavity for accommodating a chip and the support punch associated with the cavity.

DESCRIPTION OF THE PREFERRED EMBODIMENT

As indicated above, described hereinafter as a preferred embodiment of the present invention are a process and a machine for applying printing to a flat individual article whose extent perpendicularly to the at least one surface to be printed upon is generally relatively small, for example in the form of a telephone card or a like card, provided with a chip.

Figure 1:
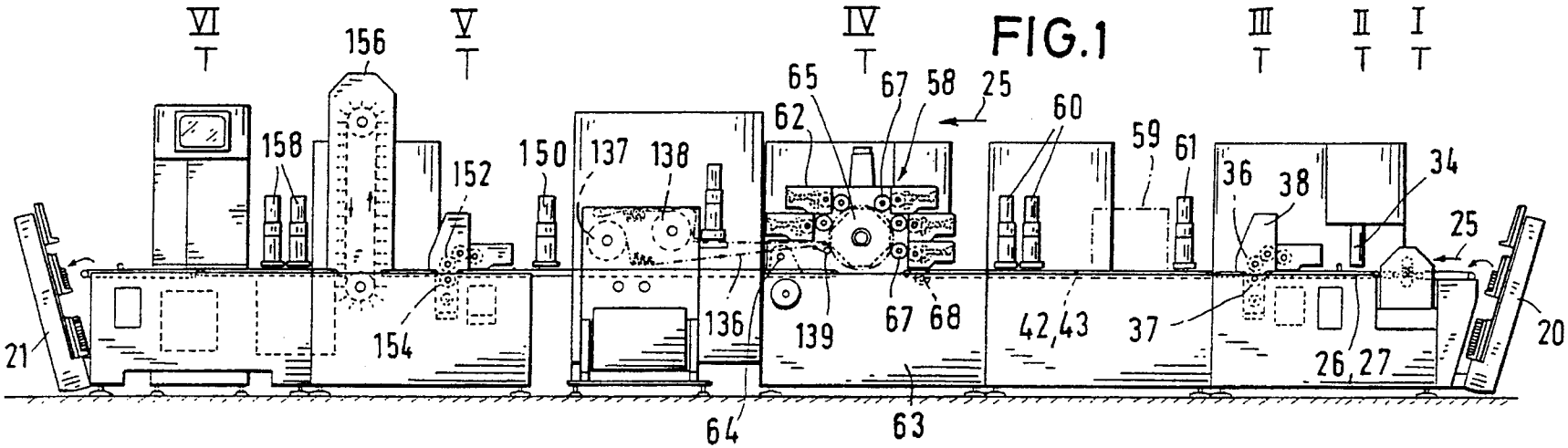
FIG. 1 is a diagrammatic side view of a printing machine for printing on telephone cards or like cards which are provided with a chip.
Figure 2:
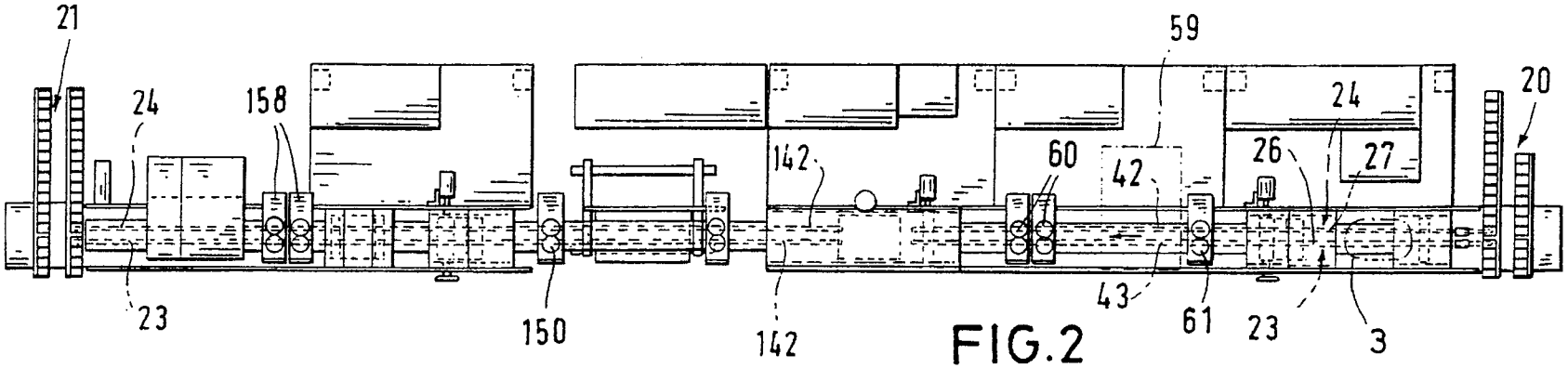
FIG. 2 is a plan view of the FIG. 1 machine.

Referring firstly to FIGS. 1 and 2, shown therein is a machine which is of a substantially linear construction such that the articles to which printing is to be applied are supplied at one end of the machine from a magazine device 20 and, after passing through treatment stations which will be described in greater detail hereinafter, are received at the other end of the machine, at the left in FIGS. 1 and 2, by a collecting device 21 and from there are passed for further treatment or use. As, in the illustrated embodiment, two articles are respectively transported in pairs through the machine and subjected to processing therein, the spacing between the two devices 20 and 21 is bridged over by two parallel transport paths 23 and 24 which each have a plurality of successive transport devices.

After the articles have been transferred in their respective pairs from the magazine device 20 to the transport paths 23 and 24, the articles and more particularly in this case the flat cards such as telephone cards firstly pass through a cleaning station as indicated at I in FIG. 1 in which for example dust and the like is removed therefrom. This station involves known devices and operating steps which do not constitute part of the present invention and which therefore do not need to be described in greater detail herein for that reason.

Reference II in FIG. 1 denotes a checking station which is downstream of the cleaning station I in the transport direction as indicated by 25, the station II ascertaining whether a respective card is present in the position prescribed therefor on the two transport paths 23 and 24 which in this case are formed by two pairs of toothed belts as indicated at 26 and 27 in FIGS. 3 and 4, and whether in addition both cards are in the correct position. As, in the embodiment described herein, the cards are each provided with a respective cavity as indicated at 44 in FIG. 5, into which a chip is subsequently to be inserted, the print image which is to be applied to the respective card and which may possibly also contain data must generally be arranged and oriented in a specific fashion relative to that chip or the cavity provided for receiving it. Thus, in the one transport path, the side of the card which does not have any-cavity can have printing applied thereto, while in the other transport path, it is the side of the card which has a cavity that receives printing. If one of the relevant requirements for this procedure to take place is not fulfilled in one of the two transport paths 23, 24, two substantially vertically extending ejector pins which are indicated at 28 and 29 in FIGS. 3 and 4 and which are disposed between the two transport paths 23 and 24 are displaced in the direction of the respective arrows 30 and 31, that is to say approximately perpendicularly to the transport direction 25, whereby both cards or, if only one of the two cards is present, the card that is so present, are or is ejected. At any event, the machine operates in such a way as to ensure that there are either two cards correctly arranged and oriented on the two pairs of toothed belts 26 and 27 or that there is no card at all and the positions intended for the cards on the two pairs of toothed belts 26 and 27 are thus empty. The position assumed by the two cards relative to the respective pairs of toothed belts 26 and 27 is determined by entrainment members indicated at 33 in FIGS. 3 and 4 and which are mounted on the toothed belts 26 and 27 and which engage behind the respective cards 22 thereon, at their edges which are the trailing edges in the transport direction 25. The ejector pins 28 and 29 are actuated in dependence on the result of a checking operation performed by a monitoring device 34 which is equipped with appropriate sensors. The detection and control devices required for that procedure can be of any suitable known configuration and therefore do not need to be described in greater detail herein. In general both the checking operation using the device 34 and also ejection by actuation of the ejector pins 28 and 29 are effected during continuous transportation movement of the cards. It is however also possible, if necessary, for the pairs of toothed belts 26 and 27 to be moved with a stepwise motion so that the articles are not in motion during the checking operation and during the ejection procedure if that latter has to be performed.

Figure 6:
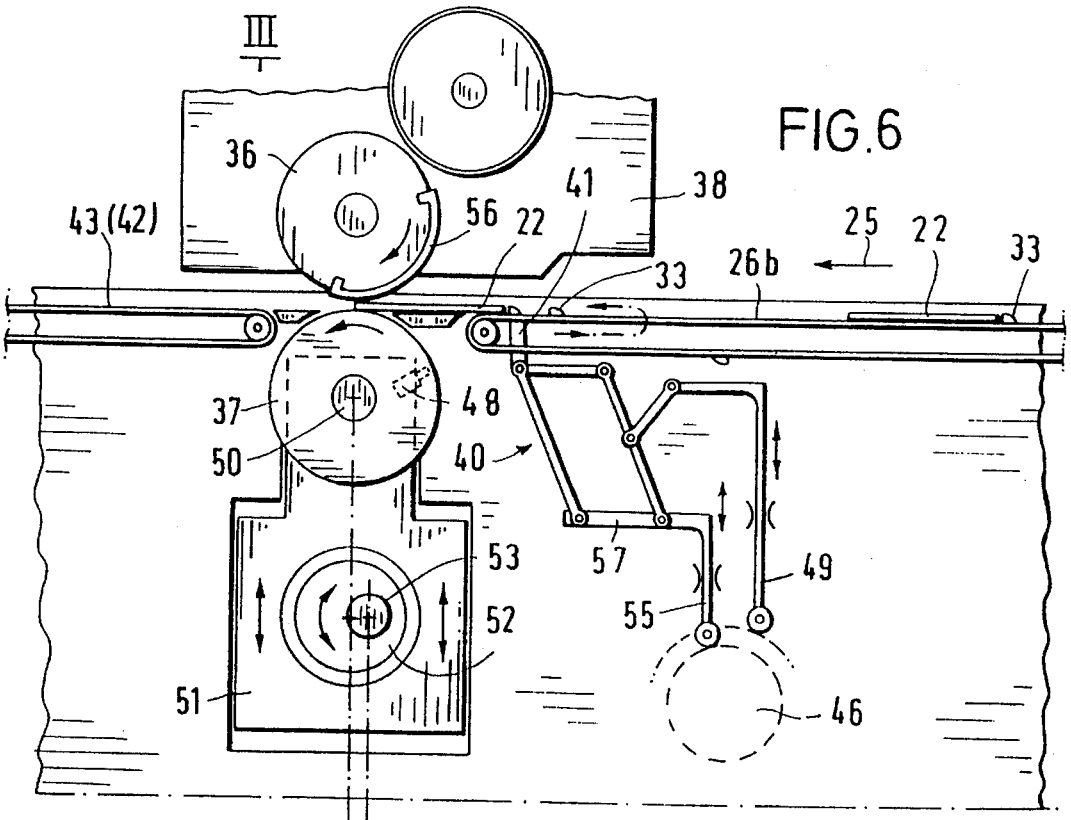
FIG. 6 is a side view on an enlarged scale of a portion from the first printing station.
Figure 7:
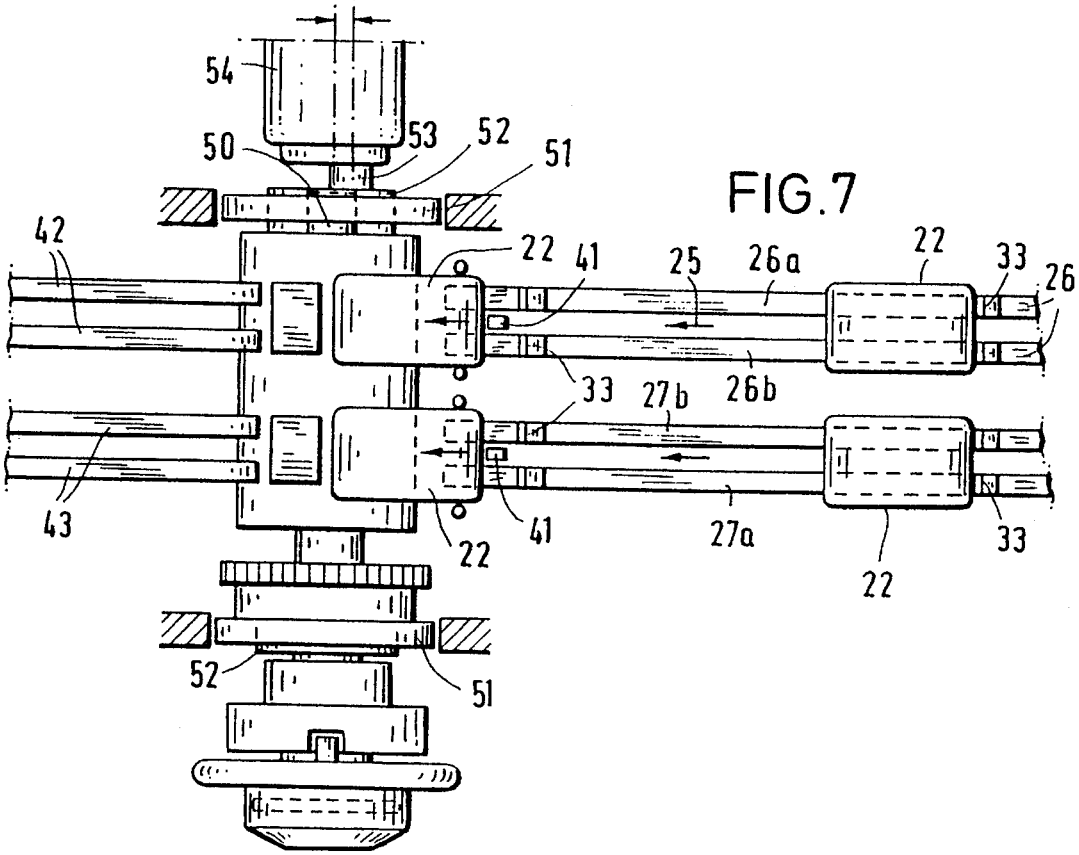
FIG. 7 is a plan view of the structure shown in FIG. 6.

Looking now also at FIGS. 6 and 7, the treatment station which follows in the transport direction 25 and which is identified at III in FIG. 1 is a single-ink printing station in which a primer is applied to the cards using an offset printing process. Arranged beneath the blanket or printing cylinder 36 which transfers the ink on to the two respective cards in the printing station III, by means of the offset printing procedure, is an impression cylinder 37 which supports the two cards during the printing operation so that as the printing procedure takes place the cards are passed in the usual manner between the two cylinders 36 and 37. The printing mechanism 38 of the printing cylinder 36 is of the usual design configuration so that once again there is no need for this to be described in greater detail herein.

FIG. 6 in particular shows that associated with the printing station III is an additional transport device 40 comprising first and second entrainment members 41, each of which is associated with a respective one of the two pairs of toothed belts 26 and 27 in such a way that the respective entrainment member 41, in a raised position as shown in FIG. 6, engages between the two toothed belts 26*a*, 26*b* or 27*a*, 27*b* of the respective pairs 26 and 27 and comes to bear behind the card 22 supported thereon and pushes it towards the two cylinders 36 and 37, in leading relationship relative to the circulating pair of Toothed belts, until the card, at its edge which leads in the transport direction 25, is engaged by the two cylinders 36 and 37 and is moved in the course of the printing operation through same towards two pairs of toothed belts 42 and 43 which are thus disposed downstream of the cylinders 36 and 37. By virtue of the selected form of drive arrangement, involving two levers 49 and 55 which are movable upwardly and downwardly by a cam disk 46 and a parallelogram assembly 57 which carries the entrainment members 41, the entrainment members perform reciprocal pivotal movements substantially in the transport direction 25 and in the opposite direction thereto. In the course of the return movement in opposite relationship to the transport direction 25, the entrainment means are disposed below the level of the cards 22 carried on the pairs of toothed belts 26 and 27 in order then at the end of that return movement to assume the upper position shown in FIGS. 6 and 7 in which they then engage again behind the cards 22 of the following pair and, advance them in an accelerated motion towards the two cylinders 36 and 37, as can be seen in particular from FIGS. 6 and 7 in which the two cards engaged by the entrainment members 41 move ahead of the entrainment members 33 of the pairs of toothed belts 26 and 27.

In the cases in which the cards 22 to which printing is to be applied are provided with a cavity as indicated at 44 in for example FIG. 5 for accomodating a chip or the like, it is necessary that, during the operation of printing on the flat surface 45 of the card 22 which does not have the cavity 44, the card is supported at the side opposite the surface 45 at least in a region 47 in which the wall portion defining the bottom of the cavity 44 is at its smallest thickness. For that purpose the impression cylinder 37 is provided with at least one substantially radially arranged punch similarly to the punch indicated at 48 in FIG. 5, which projects somewhat relative to the peripheral surface of the impression cylinder 37 and, during the operation of applying printing to the region of the card 22 which has the cavity 44, engages into the cavity 44 and thus supports the wall portion 47. The provision of that at least one punch 48 also makes it necessary to properly align the card 22 with respect to the printing mechanism.

It is possible to provide such a punch as indicated at 48 in the impression cylinder for each transport path 23 and 24, the apparatus thus having a total of two punches. It is alternatively also possible for such a punch 48 to be associated with only one of those two transport paths 23 and 24, more specifically for example when one side of the card, that is to say for example the side of the card without a cavity, is to be printed upon in one transport path, while the second side of the card, being therefore the side having a cavity, is to be printed upon in the other transport path. That includes the possibility that in the main printing station the printing cylinder may transfer different print images to the two cards to which printing is to be applied simultaneously. When the apparatus has only one transport path, that is to say, when printing is to be applied to only one respective card, a punch 48 is to be provided at any event whenever printing is to be applied to cards having a cavity; in that case, when printing is to be applied to the side of the card having the cavity, the punch is moved into an inoperative position in which it does not project outwardly beyond the peripheral surface of the impression cylinder or the support surface of a printing table which supports the card.

Looking still at FIGS. 6 and 7, reference numeral 50 therein denotes a shaft which carries the impression cylinder 37 and is mounted in a holder 51 which in turn is carried by a shaft 52 mounted rotatably in the holder 51. The shaft 52 is connected to the shaft 53 of an electric stepping motor 54, but the shaft 53 is arranged eccentrically with respect to the shaft 52 with the result that rotation of the shaft 52, produced by operation of the motor 54, produces, in dependence on the direction of rotation, an upward or downward movement of the holder 51 and therewith the shaft 50 with the impression cylinder 37. The holder 51 is suitably guided on the machine frame structure by guide means (not shown). In that way it is possible for the impression cylinder 37 to be moved by suitable actuation of the motor 54 into a position in which it is disposed at a spacing from the printing cylinder 37, which is sufficiently large to prevent contact from occurring between the two cylinders 36 and 37. The motor 54 is controlled by the monitoring device 34 in the station II in such a way that, whenever a pair of cards is missing, whether it is because the missing pair of cards did not from the outset move into the two transport paths 23 and 24, or whether it is because the pair of cards had been ejected by the ejector pins 28 and 29 for whatever reasons that my apply, the impression cylinder 37 is moved downwardly as soon as the empty positions corresponding to the two missing cards pass into the printing station II. That procedure ensures that, when cards are missing, the ink on the printing blanket 56 of the printing or blanket cylinder 36 is not transferred on to the impression cylinder 37.

After the primer has been applied in the station III, the cards are taken over by the two pairs of toothed belts 42 and 43 which have already been referred to above, disposed downstream of the cylinders 36 and 37, and further transported towards the main printing mechanism which is indicated at 58 in FIG. 1, being arranged at station IV. Some further treatment devices my be provided in the path of movement of the cards from station III to IV, for example drying devices as indicated at 61 in FIG. 1 for the printing ink which has been applied in the station III, a screen printing mechanism 59, and further driers 60. As those devices are not directly related to the present invention and as the presence thereof moreover depends on the respective parameters and requirements involved, those devices will not be described in further detail herein, especially as they can be of any suitable known configuration. For the sake of simplicity therefore it my be assumed that the pair of toothed belts 42 and 43 is operative to transport the cards to which printing has been applied in station III and which may have been subjected to further treatment as they pass into station IV, to the main station IV in which the cards are provided with multi-ink or multi-color printing.

The offset printing arrangement 58 in station IV has a generally continuously rotating blanket or printing cylinder 65, with which there are associated inking mechanisms and plate cylinders 67, the number of inking mechanisms and plate cylinders 67 corresponding to the number of inks to be employed. The embodiment illustrated in the drawing uses a five-ink printing procedure so that consequently the machine has five plate cylinders 67 which each transfer a respective partial print image on to the blanket or printing cylinder 65, those partial print images complementing each other and combining to form the overall print image. The printing cylinder 65 is thus operative to transfer the overall print image on to the individual article, that is to say the respective card 22. The printing procedures involved here and the fundamental design configuration of an offset printing mechanism and in particular also the structure of the inking mechanisms associated with the individual plate cylinders are generally known and therefore do not need to be described in further detail herein.

The offset printing mechanism 58 is mounted to be slightly movably vertically in its entirety with inking mechanisms and plate cylinders. For that purpose the printing mechanism 58 which is carried in its entirety by a support frame structure indicated at 62 in FIG. 1 is arranged pivotably about an axis indicated at 64 in FIG. 1, mounted in the machine frame assembly 63. The axis 64 extends at least substantially parallel to the drive shaft indicated at 66 in FIG. 8 of the cylinder 65. The pivot axis 64 is disposed adjacent the end, that is remote from the station III, of the support frame structure 62 which carries the printing mechanism 58. Mounted in the machine frame arrangement 63 at a spacing from the axis 64 is an eccentric indicated at 68 in FIG. 1, on which the support frame structure 62 rests. Suitable rotary movement of the eccentric 68 consequently results in pivotal movement of the entire offset printing mechanism 58 in the direction of the arrows indicated at 69 or 70 in FIG. 8. In other respects the structure of the printing mechanism 58 corresponds to that set out in above-mentioned U.S. Pat. application Ser. No. 08/176554 U.S. Pat. No. 5,456,169 to which reference is accordingly directed. Thus in this case also the periphery of the printing cylinder is provided with four printing blanket parts 72*a, b, c* and *d* which generally comprise rubber material and to the outer surfaces of which the individual images are applied by the plate cylinders, whereupon in the following printing operation the complete print image is transferred from the respective printing blanket part on to the respective article.

Figure 8:
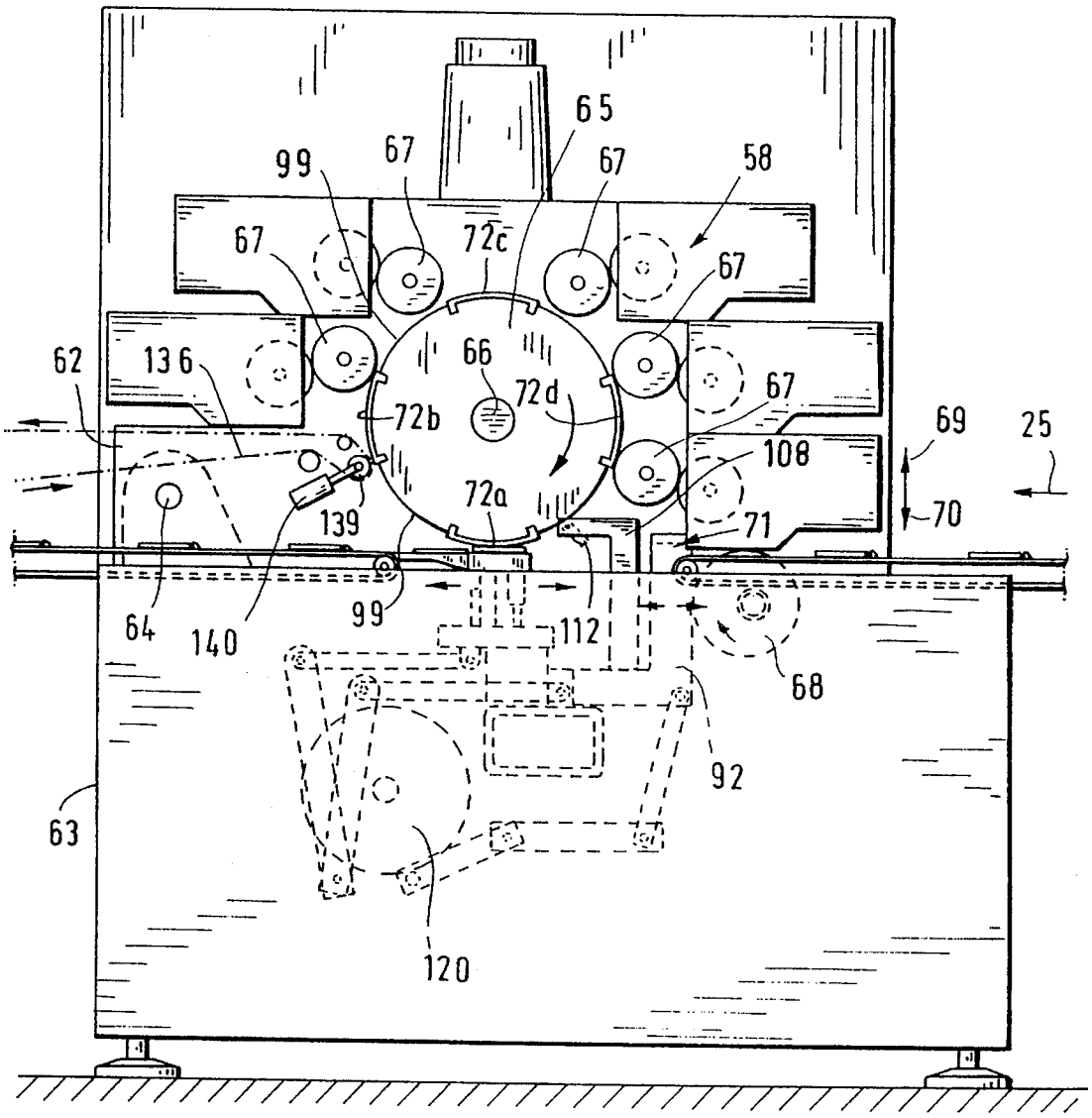
FIG. 8 is a side view on an enlarged scale of the main printing mechanism.

As in particular FIG. 8 shows, the printing blanket parts 72*a–d* are arranged in a uniformly distributed array over the periphery of the printing cylinder 65, maintaining spacings indicated at 99 therebetween. As the printing blanket parts 72*a*–d are of a certain thickness, the result of this arrangement is that the outside diameter of the printing cylinder 65, in the region of those parts 72*a–d*, is larger than in the peripheral portions 99 which are between the parts 72*a–d*, as can be seen in particular from FIG. 9. As the embodiment illustrated in the drawing provides that two cards are printed simultaneously, each of the printing blanket parts 72*a–d* also carries two, possibly different print images which are disposed in side-by-side relationship in the direction of the drive shaft 66 of the printing cylinder, while it is also possible for each of the printing blanket parts 72*a–d* to be suitably subdivided.

The above-mentioned vertical adjustability also serves to match the vertical position the printing cylinder with the printing blanket parts 72*a–d* to the position of the surface to which printing is to be applied in order in that way to set the optimum pressure between the printing blanket part and the article in the printing operation.

The transfer of the print image from the printing blanket parts 72*a–d* on to the individual articles is effected by displacement of the latter, that is to say the cards 22, relative to the rotating printing cylinder 65 which, apart from its rotation, is not displaced in that transfer operation. When printing on flat articles like telephone cards etc., it is normally not necessary to adjust the printing cylinder vertically relative to the position of the surface of the individual article to be printed upon prior to each offset printing operation in order to compensate varying thicknesses of the cards. Normally, due to the properties of the materials used for manufacturing such cards, the variations in thickness of the cards are so small that they have no effect on the printing quality.

As a specific pattern for example in the form of an image is applied to the respective cards in the printing station IV, in contrast to the procedure involved in printing station III, it is necessary for the cards each to be precisely aligned and oriented with respect to the printing cylinder 65 and the printing blanket parts 72*a–d* thereon. For that purpose, disposed between the discharging ends of the pairs of toothed belts which feed the cards to the printing mechanism, in this respect it being assumed for the sake of simplicity that the toothed belts are the toothed belts 42 and 43, and the printing mechanism 58, is an aligning device which is generally indicated at 71 in FIG. 8 and which is described in greater detail in FIGS. 9 through 14 to which reference will therefore be directed, for aligning the cards. In the aligning device 71, the cards, before being transported into the starting position for the printing operation, are aligned relative to the printing cylinder 65 or the respectively associated printing blanket part 72*a–d*. The device 71 is provided for that purpose with an aligning table 73 with two receiving surfaces 74, one receiving surface for each of the cards to which printing is to be applied. The two receiving surfaces 74 are also so arranged, in line with the respective upstream-disposed pair of toothed belts 42 and 43, in regard to their position in respect of height, in such a way that the cards which are advanced by the entrainment member co-operating with the pair of toothed belts, as a continuation of the movement produced by the respective pair of toothed belts, pass on to the respective receiving surface 74 and in so doing came free from the entrainment member 33 of the respective pair of toothed belts.

Arranged substantially centrally between the two receiving surfaces 74 is an abutment bar 76 which extends approximately in the card transport direction 25 and which has two lateral boundary surfaces 78 each forming a respective abutment against which a respective one of the cards is caused to bear for the purposes of alignment with respect to the printing cylinder 65 or the respectively associated printing blanket part 72*a–d*. The abutment bar 76 can be clearly seen in FIG. 10. To provide for alignment of the respective cards, associated with each of the two receiving surfaces 74 at the outward side thereof is a slider or pusher as at 80 in FIG. 10 which extends substantially parallel to the abutment bar 78 and which is displaceable transversely to the transport direction 75 and thus approximately transversely to the longitudinal configuration of the abutment bar 76. Therefore, disposed at each side of the abutment bar 76 is such a slider 80 which, in its initial position, is disposed at a spacing from the abutment surface 78 associated therewith, which spacing is somewhat larger than the width of the respective card 22. The cards which are transported by the pair of toothed belts 42 and 43 are thus each moved on to a respective one of the receiving surfaces 74 between the abutment bar 76 and a respective one of the sliders 80 and, by virtue of movement of the sliders 80, thereby aligned in a plane parallel to its main plane.

At its side towards the abutment bar 76, each of the two sliders 80 is defined by a surface 82 which extends substantially parallel to the associated abutment surface 78 of the abutment bar 76. Provided at each of the two ends of each slider 80 is a respective inclined surface 84*a* and 84*b* respectively, which constitutes a prolongation of the surface 82 of the respective slider while extending at an obtuse angle relative thereto. Upon transverse displacement of the respective slider towards the abutment bar 76, if necessary, a force component which is operative in the transport direction 25 or in the opposite direction thereto is applied to the respective card 22 so that, in the course of the movement of the respective slider 80 towards the abutment bar 76, the card is also displaced in the transport direction 25 or in the opposite direction thereto and thus moved into the correct position relative to the printing cylinder 65 or the printing blanket part 72*a, b, c* and *d* disposed thereon. The inclined surface 84*a* of each of the two sliders 80 is formed by a spring element in the form of a small leaf spring, the elastic deformability of which is utilized to compensate for minor inaccuracies in terms of the dimensions of the card, in particular in terms of the length thereof.

Figure 10:
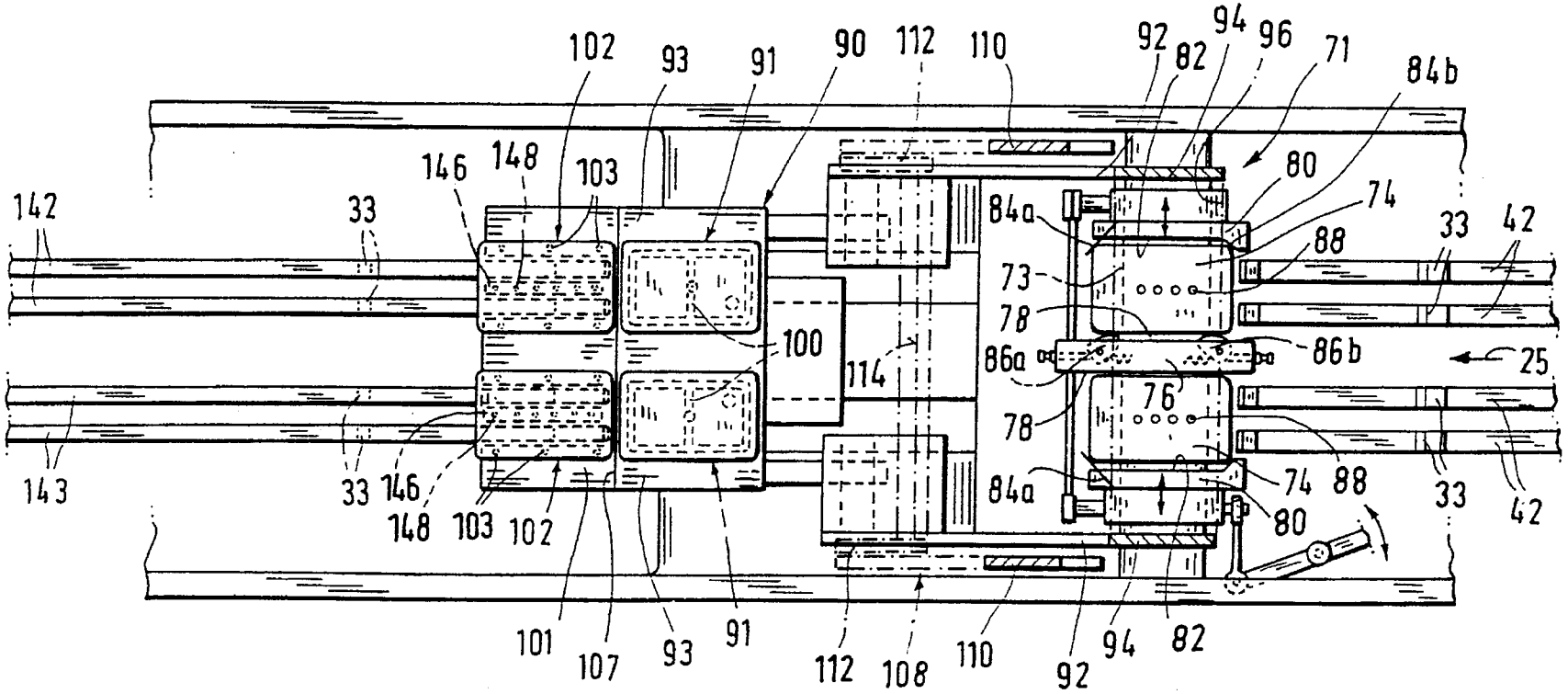
FIG. 10 is a view in section taken approximately along line X—X in FIG. 9.

Furthermore, as can be clearly seen from FIG. 10, arranged at the two end regions of the abutment bar 76, which are the leading and trailing ends in the transport direction 25, are respective portions 86*a* and 86*b* which are slightly pivotable relative to the central portion of the abutment bar 76, in a plane parallel to the receiving surfaces 74. The portions 86*a* and 86*b* can be fixed in a given pivoted position thereof. That is intended to afford the possibility that, by suitable setting of those two portions 86*a* and 86*b* or one thereof, at least one of the two cards can be set in an oriented position which deviates from a precisely parallel position with respect to the transport direction 25 or with respect to the respective other card of the associated pair which are printed together. These possible settings and the resulting deviations from a precisely parallel position for the two cards relative to each other may be desirable or even necessary if, for any reason, the print images on the print blanket parts 72*a–d* assume positions which do not correspond to a position of the respective card, that is precisely parallel to the transport direction 25. These adjustment options are advantageous in particular when pairs of cards are to be printed upon simultaneously.

In order to ensure that the cards on the receiving surfaces 74, after having been suitably aligned and oriented by the sliders 80, also retain their respective positions, both receiving surfaces 74 are provided with bores 88 which can be connected to a reduced-pressure source so that the reduced pressure acting on the cards through the bores 88 is operable to hold them in their respective positions, in spite of the vibration and the like usually encountered in a machine of this nature, although, after the aligning operation, the sliders 80 are pushed back into their initial position in which they are away from the respective card in order to release the card. As will be described in greater detail hereinafter, it may be desirable to proceed in such a way that the reduced pressure is operative continuously, that is to say also during the step of aligning the cards by means of the sliders 80. The alignment procedure is not impeded by this, as in any case the sliders 80 will push the cards into the appropriately aligned position, even against the holding action of the reduced pressure.

Further transportation of the two cards 22 from the aligning table 73 into the initial position for the actual printing procedure must thus be effected in such a way that the alignment of the cards, which was produced relative to the respective printing blanket part 72*a–d*, is maintained. It has already been mentioned that the printing cylinder, apart from the pivotal movements produced by the eccentric 68 in the direction of the arrows 69 or 70, does not experience any displacement so that accordingly the articles to be printed upon are moved linearly during the printing operation, in accordance with the progress of the printing procedure, synchronously with the rotary movement of the printing cylinder 65. For that purpose the apparatus is provided with a holding device 90 which is in the form of a printing table and which is arranged beneath the printing cylinder 65 movably in a substantially horizontal plane in the transport direction 25 and in the opposite direction thereto.

Figure 9:
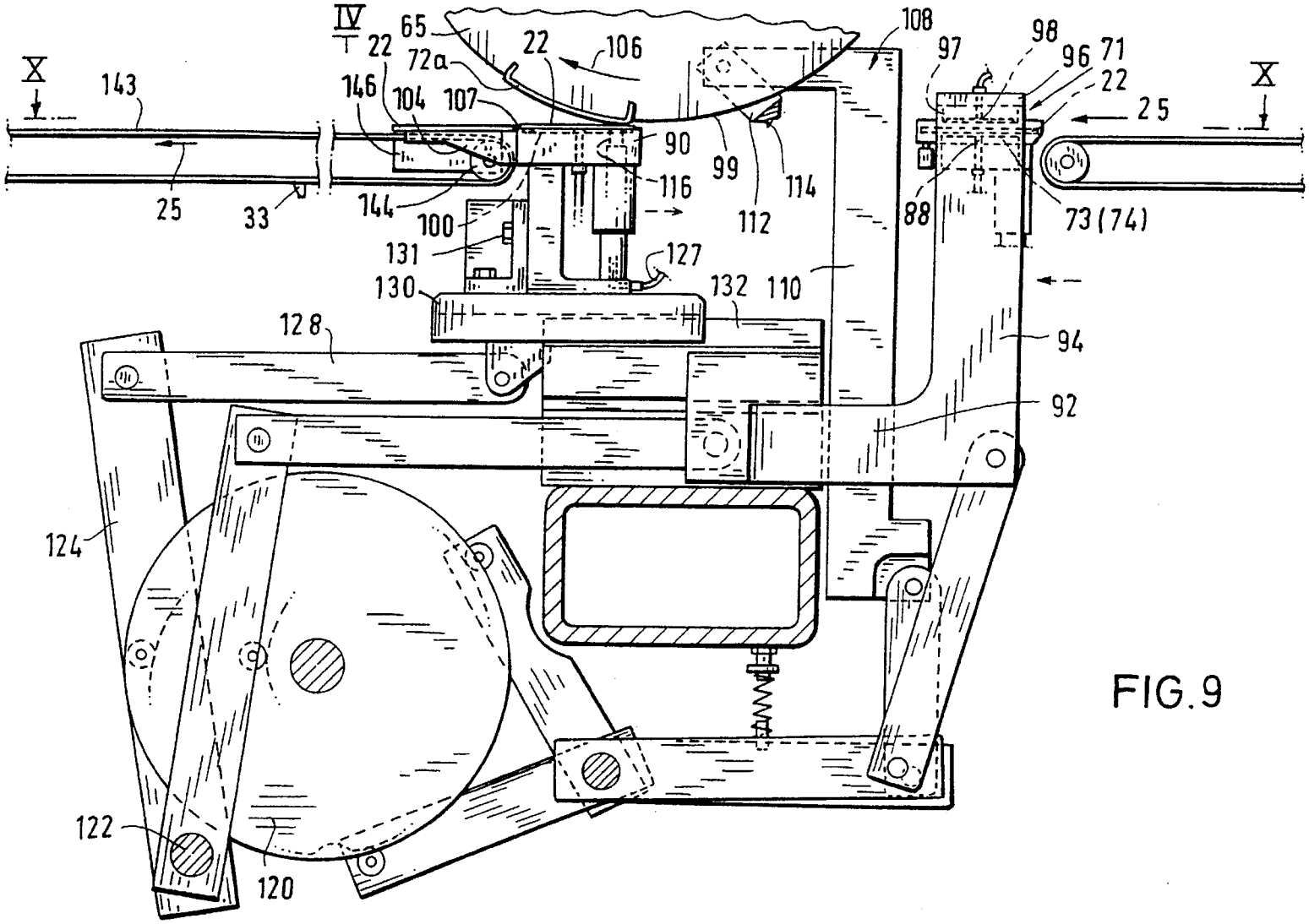
FIG. 9 is a view on a still larger scale of a portion from FIG. 8 with the printing table carrying the article to which printing is to be applied, in a left-hand limit position.
Figure 13:
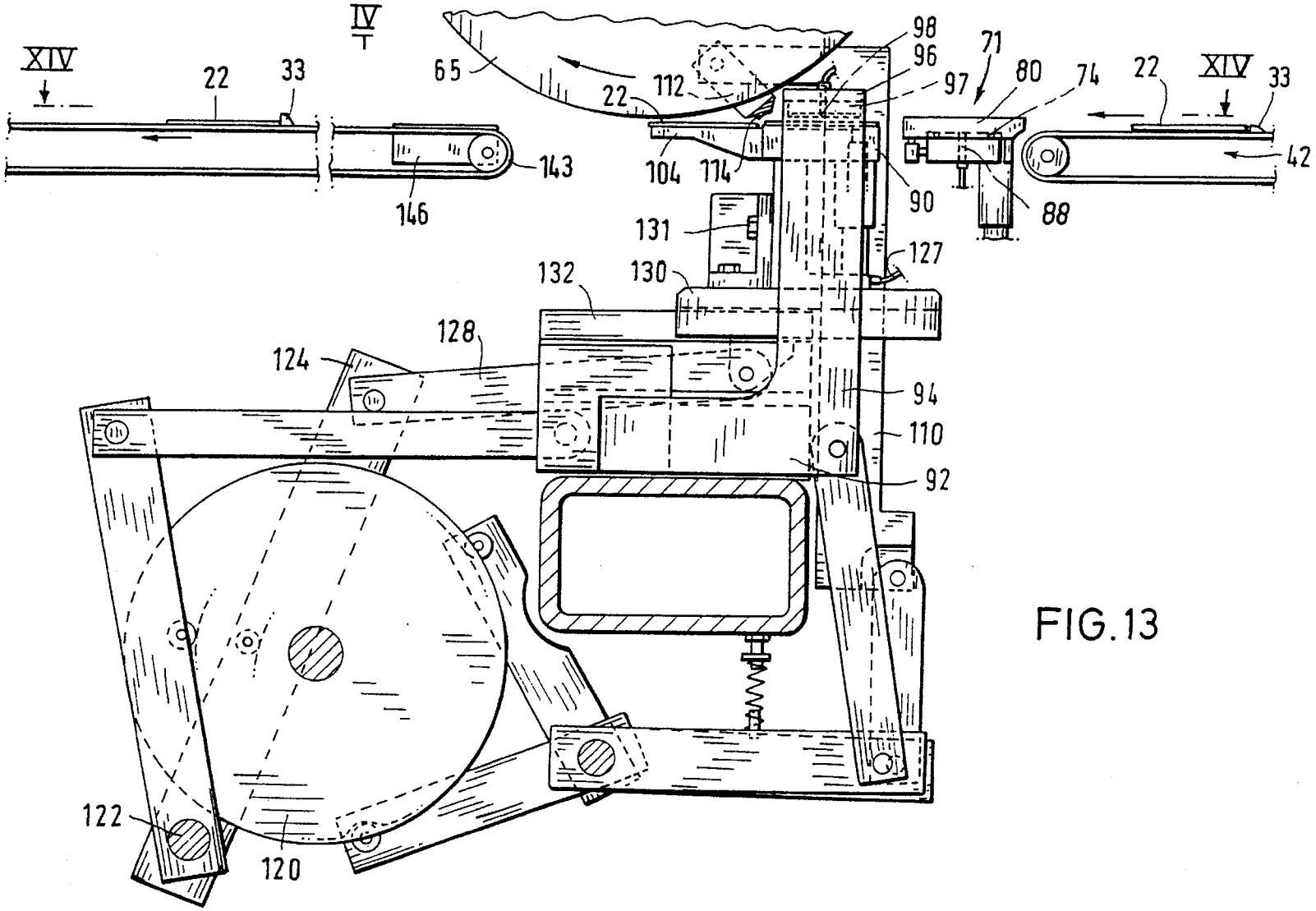
FIG. 13 is a view corresponding to that shown in FIG. 9, with the printing table in its right-hand limit position.
Figure 14:
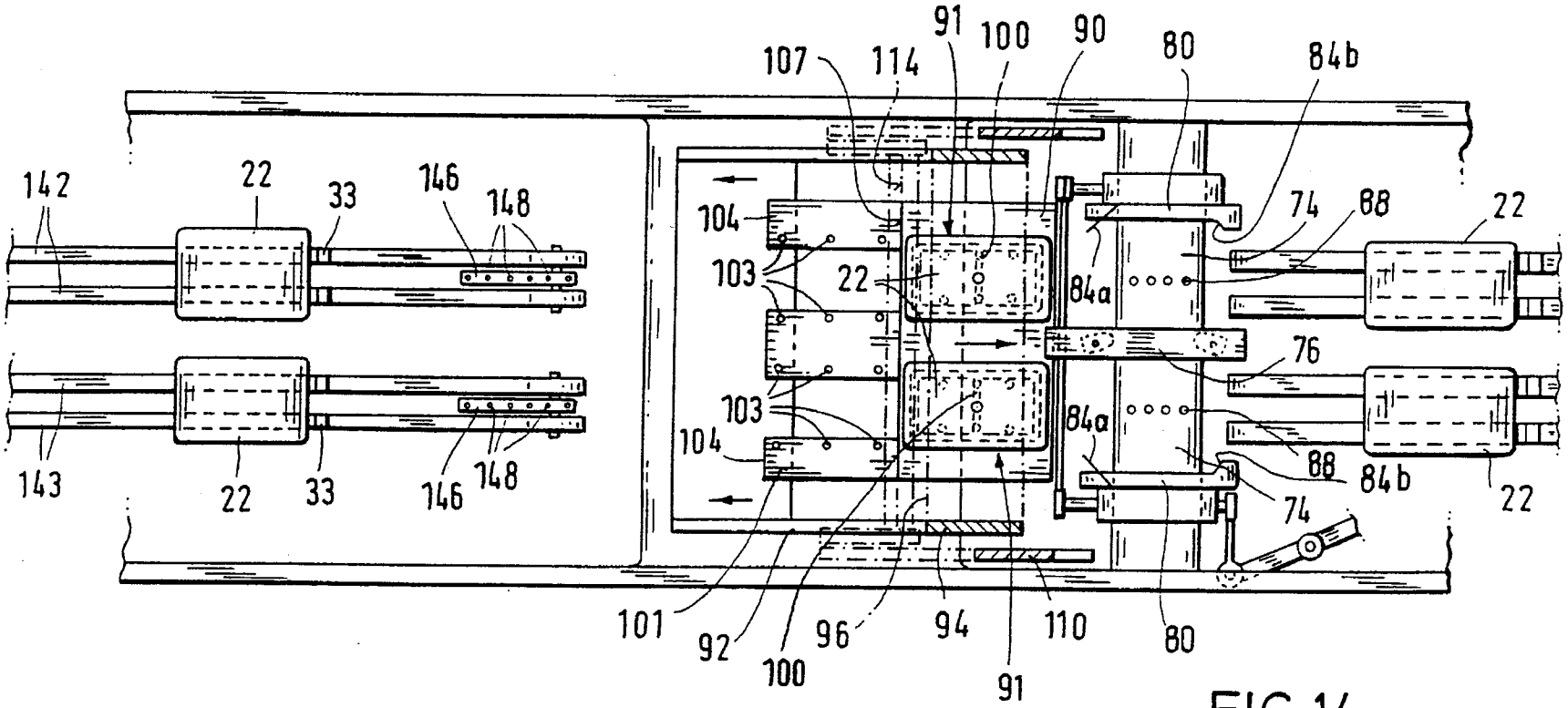
FIG. 14 is a view in section taken approximately along line XIV—XIV in FIG. 13.

Reference will now be made to FIGS. 9 and 10 showing the table 90 approximately in its left-hand limit position, that is to say approximately at the end of the printing operation. FIGS. 13 and 14 on the other hand show the printing table 90 in its right-hand limit position in which it receives the cards 22 to which printing is to be applied.

Figure 11:
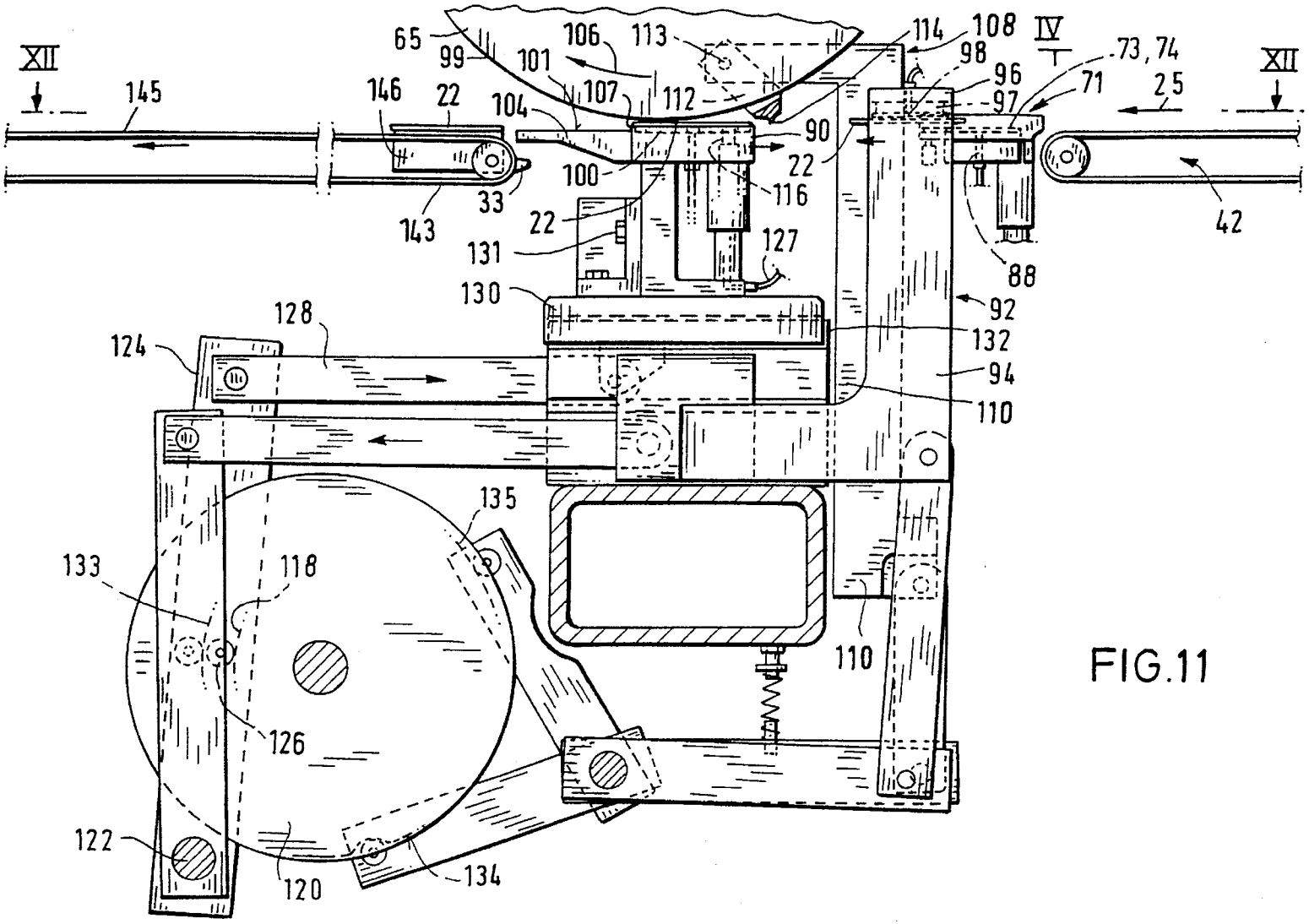
FIG. 11 is a view corresponding to that shown in FIG. 9, but with the printing table in a position between its left-hand limit position and its right-hand limit position.

For the purposes of transporting the cards from the aligning table 73 to the printing table 90, the apparatus is provided with a transfer device 92 as is generally indicated diagrammatically in FIG. 8 and in greater detail in FIG. 9. The transfer device 92 is in the form of a transfer frame assembly and has two lateral, substantially vertically extending frame members 94 and a transverse member 96 which connects the two frame members 94 at the top ends, for bridging over the aligning table 73 and the printing table 90. The transfer frame assembly is reciprocal between a limit position as shown in FIGS. 9 and 10, in which the transverse member 96 is disposed above the aligning table 73, and a limit position as shown in FIGS. 13 and 14. The frame can additionally perform vertical movements. At its underside, in the regions which in the receiving position of the transfer frame arrangement 92 are disposed above the receiving surfaces 74 of the aligning table, the transverse member 96 of the frame arrangement is provided with downwardly projecting extensions 97, through which are passed downwardly open bores 98 as indicated in FIG. 11, which are connected to a reduced-pressure source. This may be the same reduced-pressure source as that to which the bores 88 in the receiving surfaces 74 are also connected.

In its right-hand limit position, the transfer frame arrangement 92 is moved downwardly to such a degree that the suction action exerted by way of the suction bores 98 in the transverse member 96 exceeds the suction action of the suction bores 88 in the receiving surfaces 74 and, in the upward movement of the transfer frame arrangement which then takes place, the two aligned cards are lifted off the receiving surfaces 74 by the transverse member 96 and in that case adhere so firmly to the transverse member 96 that the cards do not suffer any displacement relative to the transverse member 96, under the usual operating conditions. In this situation, the procedure can be such that, while the cards are being taken over by the transverse member 96 of the transfer frame arrangement 92, the reduced pressure which acts through the bores 88 in the receiving surfaces 74 remains operative. To achieve that, it is only required that, with the same reduced pressure, the sum of the cross-sectional areas of all openings of the bores 98 in the transverse member 96 is correspondingly greater than the sum of the cross-sectional areas of all openings of the bores 88 in the receiving surfaces 74. That can be achieved in a simple manner for example by a correspondingly larger number of suction bores 98 in the transverse member 96.

In the second limit position of the transfer frame arrangement 92, as shown in FIGS. 13 and 14, the transverse member 96 thereof is disposed above the printing table 90 which at that time is in its right-hand limit position. The portion 93, that is towards the aligning table 73, of the printing table 90 above which the transfer frame arrangement 92 is disposed in its left-hand limit position as shown in FIGS. 13 and 14 is formed as a holder for the articles to be printed upon, during the printing operation. For that purpose the printing table 90 has two receiving surfaces 91, on which the two cards clinging to the transverse member 96 are deposited. In its transfer position, that is to say in its left-hand limit position, the transfer frame arrangement 92 initially assumes a position in respect of height in which the underneath surfaces of the cards adhering to the lower extensions 97 of the transverse member 96 are above the receiving surfaces 91 of the printing table 90. The transfer frame arrangement 92 is then lowered so that the cards clinging thereto came into contact with the top side of the printing table 90 in the region of the receiving surfaces 91. Those receiving surfaces 91 are provided in their top side with groove-like passages 100 or bores which are connected to a reduced-pressure source which may be the same source as that to which the suction bores 88 and 98 of the aligning table 73 and the transverse member 96 are also connected. In order to provide, without additional measures, that the cards are not entrained by the transverse member 96 in the subsequent, initially upwardly directed movement thereof, it is necessary for the suction action exerted by the printing table 90 to be suitably greater than that applied by the bores 98 in the transverse member 96. In this case also that can be achieved in a simple manner by the sum of the areas at which the reduced pressure is effective at the respective receiving surface 91 of the printing table 90 being suitably larger than at the transverse member 96. In this case also the operation of transferring the cards can be effected without any need to modify the suction effect or to switch it off or on respectively. In any case, that would take up so much time that the output of the apparatus would be noticeably reduced thereby.

After the cards have been delivered to the printing portion 93 of the printing table 90, the frame arrangement 92 is moved towards the right again into the position shown in FIGS. 9 and 10, to receive the next pair of cards from the aligning table 73.

Adjoining the portion 93 of the printing table 90, which has the two receiving surfaces 91, is a transfer portion 101 on to which the printed cards are moved after the printing operation in order to liberate the receiving surfaces 91 for the next pair of cards. The transfer portion 101 which also has two receiving surfaces 102 is stepped somewhat relative to the printing portion 93 with the receiving surfaces 91, on which the cards lie during the printing operation, in such a way that the surface of the transfer portion 101 with the receiving surfaces 102 is slightly lower than the surface of the printing portion with the receiving surfaces 91.

Figure 12:
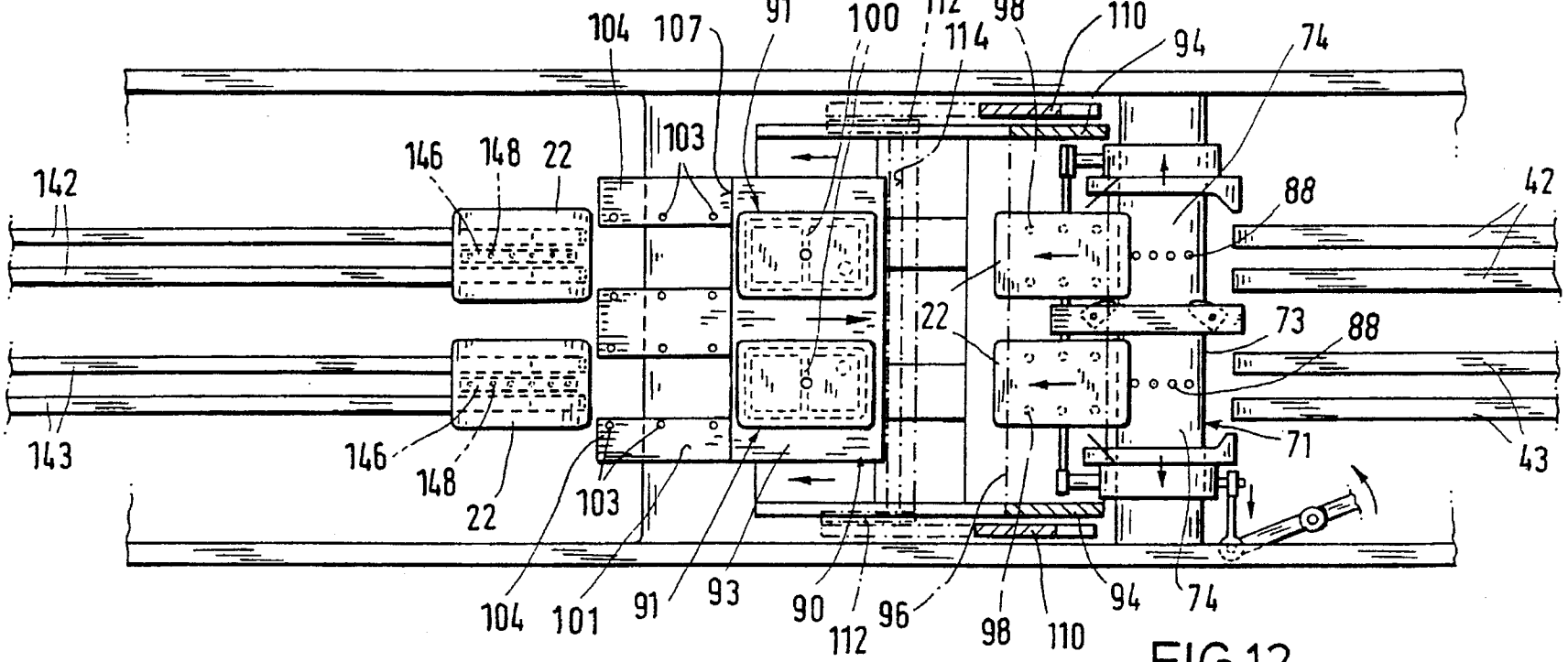
FIG. 12 is a view in section taken approximately along line XII—XII in FIG. 11.

The transfer portion 101 which is part of the printing table 90 comprises three bars which are indicated at 104 and which can be clearly seen from FIG. 12, extending parallel to the transport direction 25 while being at spacings from each other transversely to that direction. The upper surfaces 102 of the bars 104 are provided with bores or passages 103 which are connected to a reduced pressure source which may be the same source as that to which the suction bores of the other elements are connected.

The printing operation begins after delivery of the pair of cards from the transfer frame arrangement 92 to the printing portion 93 of the printing table 90. The latter is then moved in the transport direction 25 in such a way that the speed of movement of the table corresponds to the peripheral speed of the surface of the printing blanket part which transfers to two print images on to the respective two cards. FIGS. 9 and 10 show the position of the apparatus components approximately at or shortly before the end of the printing operation, in which the print images have been transferred from the printing blanket part 72*a* on to the pair of cards which are still in the printing portion 93 of the printing table 90. At the end of the printing operation the printing blanket part 72*a* comes out of contact with those two cards so that the printing table 90 can be moved back out of the position shown in FIGS. 9 and 10 in the opposite direction to the transport direction 25, without the previously printed cards which are still disposed on the printing portion 93 coming into contact with the peripheral surface of the rotating printing cylinder 65 as the diameter thereof in the peripheral portions 99 between the printing blanket parts 72*a–d* is smaller than the diameter in the region of the latter. FIGS. 11 shows the position of the printing table 90 on the way into its right-hand limit position. It can be seen that the pair of cards in the printing portion 93 is disposed opposite the peripheral portion 99 which is arranged, in the direction of rotation 106 of the printing cylinder 65, between the printing blanket part 72*a* which however is not shown here and the following printing blanket part 72*b* which is also not shown. The pair of cards which are disposed in the transfer portion 101 and to which printing had been applied in the preceding working cycle are in any case at a lower level by virtue of the step 107 between the portions 93 and 101 of the printing table 90.

Furthermore, arranged in the printing station IV is a stripper frame which is indicated generally at 108 in FIG. 8 and shown in greater detail for example in FIGS. 9 through 13. The frame 108 has two lateral frame members 110 which are connected together by a transverse member indicated at 112 in FIG. 10, which represents the actual stripper member. The stripper frame is movable upwardly and downwardly between a lower position in which a short extension 114 mounted on the transverse member 112 at the underside thereof extends into the path of movement of the cards lying on the receiving surfaces 91 of the printing table 90, and an upper position in which the transverse member 112 is disposed above that path of movement. In the return movement of the printing table 90, which takes place in the opposite direction to the transport direction 25, the stripper frame with the transverse member 112 assumes the lower position, as is illustrated in FIG. 11. The consequence of this is that, in the course of that movement of the printing table, the two cards on the printing portion 93, shortly after the printing table reaches the position shown in FIGS. 11 and 12, hit against the extension 114 and are thus prevented from further moving and are accordingly displaced relative to the printing table 90 from the printing portion 93 thereof into the transfer portion 101 adjoining it in the transport direction 25, and at the end of that movement of the printing table lie on the somewhat lower receiving surfaces 102 of the portion 101, as is shown in FIGS. 13 and 14. In that way, the receiving surfaces 91 of the printing portion 93, which serve to hold the cards during the printing operation, are liberated so that the next pair of cards can be transferred to the printing table 90 from the transfer frame arrangement 92 for the following printing operation, in the manner already described above. FIGS. 13 and 14 show the situation approximately at the moment of transfer. In the course of the following movement from the position shown in FIGS. 13 and 14 into the position shown in FIGS. 9 and 10, the pair of cards which have just been put on to the printing portion 93 have printing applied thereto. In the same movement the pair of cards which were printed in the preceding working operation and which are in the transfer portion 101 are moved in the transport direction 25 without coming into contact with the peripheral surface of the printing cylinder 65, by virtue of the receiving surfaces 102 being at a lower level.

Before or during the return movement of the printing table 90, which in turn takes place after conclusion of that printing operation, into the position shown in FIGS. 9 and 10, the stripper frame 108 is again lowered into the position shown in FIGS. 11 and 12, with the result that the printed pair of cards now disposed on the printing portion 93 is displaced relative to the printing table 90 towards the transfer portion 101 in the manner already described above.

The position of the receiving surfaces 102 of the transfer portion 101 at a level which is lower than that of the receiving surfaces 91 of printing table 93 has the main function to avoid printing ink also being transferred to the cards which had been printed in the respective preceding working cycle during printing of the cards positioned in printing portion 93. In addition the step between printing portion 93 and transfer portion 101 has the effect that in the course of the movement of printing table 90 opposite to direction of transport 25 the printing cards come out of engangement with stripper member 112 at the latest at a point of time when the cards with their complete longitudinal extension are supported by the transfer portion 101, provided that the height of the step between printing portion and transfer portion is at least as large as the distance by which stripping member 112 projects into the paths of movement of the cards. In the embodiment depicted in the drawing the height of step 107 is about half the thickness of a card. Further, the step 107 can also have the function of an abutment which contributes to maintain the cards supported by transfer portion 101 in position when the printing table 90 is moved in the direction 25 of transport.

When the printing table 90 is in the right-hand limit position as shown in FIGS. 13 and 14, there are two pairs of cards thereon, of which the right-hand pair has just been delivered from the transfer frame arrangement 92 on to the printing portion 93 of the printing table 90 and is to be printed upon in the following working cycle. The left-hand pair of cards, which were printed in the preceding working cycle, is disposed on the bars 104 of the transfer portion 101. The spacings between the bars 104 are so selected that, in the left-hand limit position shown in FIGS. 9 and 10, a respective pair of toothed belts 142, 143 is disposed with its end region, including toothed guide wheels indicated at 144 in FIG. 9, between two adjacent bars 104. A stationary suction bar 146 is arranged between the toothed belts 142 of each pair, in the end region thereof, the bar 146 having a plurality of upwardly open bores connected to a reduced-pressure source. The arrangement here is such that the top flat surface of the suction bars 146 projects upwardly somewhat relative to the top surface of the upper portions as indicated at 145 in FIG. 11 of the toothed belts 142, 143, and extends substantially in or slightly below the horizontal plane in which the receiving surfaces 102 of the transfer portion 101 extend. When the printing table moves in the course of the printing operation towards the left into the limit position shown in FIGS. 9 and 10, the above-outlined arrangement provides that the two cards on the transfer portion 101 are pushed on to the respectively associated suction bar 146 and are firstly held by the suction effect applied to the cards through the suction bores 148 in a position in which they are disposed at the end of the movement, towards the left, of the printing table 90. Here, too, the arrangement is such that the suction effect of the respective suction bar 146 is greater than the suction effect which is applied to the card through the suction bores 103 in the respective receiving surface 102, so that in the following movement of the printing table 90 opposite to the direction of transport 25 into the second limit position depicted in FIGS. 13 and 14, the cards which are positioned on or at a very small distance above the respective suction bar 164 are kept in place by the suction applied by the suction bar. The cards remain in this position until the following entrainment member 33 carried on the toothed belts engages behind the respective card from below in the last phase of passing around the guide wheels 144, and transports the cards further along in the transport direction 25, as this is shown in FIG. 13 and 14. During this transport, the cards are supported by the upper sections 145 (FIG. 11) of toothed belts 142, 143.

At the same time, but possibly prior to this, the printing table 90 can again be moved in the opposite direction to the transport direction 25, that is to say towards the right, to initiate the next working cycle.

The use of a flat table as in the case of the printing table 90 instead of an impression cylinder as is used for example in the station III takes account of the fact that the printing cylinder 65 of the printing mechanism 58 is of relatively large diameter and thus has a peripheral surface with a relatively small degree of curvature. When using an impression cylinder, depending on the nature of the respective printing ink used, that could have the result that the article to which printing is to be applied, that is to say for example the card, adheres by way of its printed, substantially flat surface to the printing cylinder or the respective printing blanket part, and is entrained thereby after the printing operation is terminated. The use of the printing table with flat receiving surfaces for substantially flat articles ensures that the cards do not remain clinging to the printing cylinder, especially as the cards are in any case held in their position on the printing portion 93 by the reduced pressure acting on the cards. As can be seen for example from FIGS. 9 and 11, the printing portion 93 is also provided with at least one punch as indicated at 116 which, in the manner already described in connection with the punch indicated at 48 in FIG. 5, engages into the cavity 44 in at least one of the respective cards on the printing portion 93. In that respect, such a punch 116 can be associated with each receiving surface 91, depending on the respective circumstances and parameters involved. It is however also possible for only one of the two receiving surfaces 91 to be provided with such a punch, if the other surface is used only for printing on the side of the card, which is provided with the cavity. The drive for the reciprocating movements of the printing table 90 are taken from a cam indicated at 118 in FIG. 11 on a cam disk 120. Looking at FIGS. 9 and 11, for that purpose the arrangement has a lever 124 which is pivotable about an axis 122 and which carries a cam follower roller 126 (FIG. 11) guided in the cam 118. The movements of the lever 124 are transmitted by a bar 128 to a carriage or slide 130 which mounts the printing table 90 with punch and other associated components, by means of a screw 131, that is to say in such a way as to be easily interchangeable. The slide 130 is mounted for reciprocating sliding movement on a guide 132.

The movements of the transfer frame arrangement 93 and the stripper frame 108 are also derived by way of suitable transmission members from the cam disk 120 which for that purpose is provided with suitable cams indicated at 133, 134 and 135 in FIG. 11. The positive guidance effect which is afforded in that way guarantees in any event that the movements of the components are correctly co-ordinated with each other. As the movements of the transfer frame arrangement 92 have both a vertical and a horizontal component, two groups of the transmission members are provided for that purpose.

The at least one punch 116 associated with the printing table 90 is carried by a pneumatically actuable piston unit which makes it possible for the punch 116 to be reciprocated between a first operative position and a second position in which it does not project relative to the respective receiving surface 91 of the printing portion 93. It is thus readily possible, for the printing operation, for the at least one punch 116 to be moved into the cavity and to be moved out of the cavity again after the printing operation has been concluded, thereby to nullify the positively locking interengagement between the card and the punch, so that the card can be displaced from the printing portion 93 on to the transfer portion 101 by the transverse stripper member 112 in the above-described manner. The pressure medium required for displacement of the punch 116 is supplied by way of the conduit indicated at 127 in for example FIG. 11. The arrangement including the punch 116, which thus comprises the above-mentioned piston unit consisting of a cylinder with piston guided therein, is mounted on the holder 90 adjustably in respect of height in order to be able to adapt the initial starting position of the punch to the respective requirements involved. The stroke movement of the piston carrying the punch 116 can also be adjustable. The transverse stripper member 112 is mounted on the frame arrangement 108 pivotably about the axis indicated at 113 in FIG. 11 so that, if a resistance occurs due to an obstacle or the like, the transverse stripper member 112 can pivot upwardly against the force of a spring means which urges the transverse stripper member 112 towards the position illustrated in the drawing.

Reference will now be made to FIGS. 1 and 8 showing a web of material 136 which is associated with the offset printing arrangement 58 and which is drawn off a supply roll 137 and wound on to a second roll 138 after having been used, in the usual manner. The web of material 136 is passed over an impression cylinder 139 which is arranged near the printing cylinder 65 and which is arranged reciprocally by way of a piston-cylinder unit indicated at 140 in FIG. 8 between a position in which the portion of web 136 which is passed around the impression cylinder 139 comes into contact with the surface of one of the printing blanket parts 72*a–d*, and a position in which it is at a spacing from the printing cylinder 65, such as to exclude contact between the web of material 136 and the printing blanket parts. If the impression cylinder 139 occupies a position in which the web of material comes into contact with one of the printing blanket parts 72*a–d*, the print image which is on that printing blanket part is transferred on to the web of material 136. During normal operation, control of the impression cylinder 39 can be effected by the monitoring arrangement 34 which is operative to establish whether articles to which printing is to be applied are present in the transport paths and also correctly arranged and oriented. If articles are missing, for example because they have been removed by the ejectors 28 in station II, the printing mechanismn 58 is lifted somewhat in its entirety by suitable actuation of the eccentric arrangement 68 in order to prevent the printing blanket part associated with the respective empty locations from coming into contact with any parts of the printing table 90. In addition, the impression cylinder 139 is moved, also by operation of the monitoring arrangement 34, into its operative position in which the web of material, in the region of the impression cylinder 139, is brought into contact with the printing blanket part associated with the empty locations so that the printing ink is taken from that printing blanket part. In other words, in that situation, the material web 136 performs the function of a substitute article. The web of material can further be used for carrying out test runs at the beginning of a printing period to provide for operational preparation of the printing mechanism 58 or test its operability, without any need for that purpose to use normal articles, that is to say for example cards. The impression cylinder 139 can also be used to check the positions of the individual printing blanket parts 72*a–d* and thus the positions of the surfaces thereof. In regard to details in this respect attention is again directed to above-mentioned U.S. Pat. application Ser. No. 08/176,554 (U.S. Pat. No. 5,456,169) the disclosure of which is hereby incorporated by reference thereto.

Referring again to FIGS. 1 and 2, it will be seen therefrom that the cards which are advanced on the two pairs of toothed belts 142 and 143 pass through a UV-drier 150 before they pass into a further offset printing station V which is also a single-ink printing station, similarly to the station III. A lacquer is applied to the cards in the station V. In other respects the station V is of a similar structure to the station III, that is to say it has a printing or blanket cylinder 152 and an impression cylinder 154, and therefore does not need to be described in full detail here again.

Subsequently thereteo the cards pass through a device 156 in which the excess of the lacquer applied in the station V drains off, for the cards thereafter to pass through beneath two UV-driers 158.

Thereafter the cards can pass through a check station VI in which the quality of the printing is checked before the cards are then transferred to the collecting device 21. Depending on the respective circumstances involved, the procedure in this respect can be such that for example the cards from the one transport path in which the first printing is applied to the cards are returned to the beginning of the other transport path so that printing can then also be applied to the second side of the card.

It will be seen therefore that the process and apparatus according to the principles of the present invention make it possible to print at least once on flat individual articles whose extent perpendicularly to the at least one surface to be printed upon is generally relatively small, affording a high rate of production and a high level of operational reliability, with highly accurate printing results. The process and apparatus according to the invention can more specifically be used in relation to cards and like articles generally made from plastics and provided with at least one recess or opening therein, for example for accomodating a chip.

It will be appreciated moreover that the above-described process and apparatus according to the present invention have been set forth solely by way of example and illustration of the invention and that other modifications and alterations may be made therein without thereby departing from the spirit and scope of the invention.

What is claimed is:

1. A process for printing on individual articles which each have at least one surface to be printed upon and which are each of a relatively small extent perpendicularly to said at least one surface to be printed upon, using at least one offset printing arrangement comprising at least two plate cylinders and a printing cylinder having a periphery provided with at least one transfer means on to which partial print images are transferred from the plate cylinders, at least two said partial print images being transferred on to said surface of a said article from the transfer means to provide an overall print image on said surface, wherein before the article is moved into the starting position for the printing operation the article to be printed upon is firstly aligned in an aligning device relative to the transfer means of the printing cylinder and then while maintaining the aligned position moved by a transfer device on to a holding device and into the starting position for the printing operation and then the holding device with the article is moved in a first direction relative to the printing cylinder at a speed corresponding to the peripheral speed of the transfer means in order to transfer the print image from the transfer means on to the article which is in contact therewith.

2. A process as set forth in claim 1 wherein said transfer device is reciprocal between the aligning device and the holding device in the starting position.

3. A process as set forth in claim 1 wherein the article is held in its aligned position in the aligning device by the action of a reduced pressure.

4. A process as set forth in claim 1 wherein for said movement of the article from the aligning device to the holding device the article is removed from the aligning device by a reduced pressure applied to the article by the transfer device and is held thereby during transportation into the starting position for the printing operation.

5. A process as set forth in claim 1 wherein the article is discharged from the transfer device to the holding device by a reduced pressure which acts on the article by way of the holding device which carries the article during the printing operation.

6. A process as set forth in claim 4 wherein when the article moves from the aligning device to the transfer device the reduced pressure applied by the aligning device and the reduced pressure applied by the transfer device are simultaneously operative and the suction effect caused by the reduced pressure at the transfer device is greater than that at the aligning device.

7. A process as set forth in claim 5 wherein when the article moves from the transfer device to the holding device the reduced pressure applied by the transfer device and the reduced pressure applied by the holding device are operative simultaneously and the suction effect caused by the reduced pressure at the holding device is greater than that at the transfer device.

8. A process as set forth in claim 6 wherein each reduced pressure is maintained uninterruptedly.

9. A process as set forth in claim 7 wherein each reduced pressure is maintained uninterruptedly.

10. A process as set forth in claim 6 wherein the suction effect which increases in the direction of transport of the article from the aligning device to the transfer device is achieved by a procedure whereby substantially the same reduced pressure is operative at both said devices and the different suction effects are achieved by suitable dimensioning of the surface areas at which the respective reduced pressure acts on the article.

11. A process as set forth in claim 7 wherein the suction effect which increases in the direction of transport of the article from one device to the respective following device is achieved by a procedure whereby substantially the same reduced pressure is operative simultaneously at both said consecutive devices and the different suction effects are achieved by suitable dimensioning of the surface areas at which the respective reduced pressure acts on the article.

12. A process as set forth in claim 1 wherein the transfer device and the holding device are reciprocated in opposite relationship.

13. A process as set forth in claim 1 wherein the article is transported into the aligning device in a transport direction and is then aligned with respect to the transfer means in the course of a movement of the article transversely with respect to the transport direction.

14. A process as set forth in claim 1 wherein during a printing operation the article is supported on an article-receiving surface of a printing portion of the holding device, at which printing portion a reduced pressure is caused to act on the article, wherein after the printing operation the holding device performs a return movement, and wherein in the course of the return movement the article is moved from said printing portion on to a transfer portion of the holding device, the transfer portion having an article-receiving surface which is lower than the article-receiving surface of the printing portion.

15. A process as set forth in claim 14 wherein displacement of the article relative to the holding device from the printing portion to the transfer portion is effected by the article being engaged by an abutment which in said return movement of the holding device projects into the path of movement of the article on the printing portion.

16. A process as set forth in claim 14 wherein displacement of the article from the printing portion to the transfer portion occurs against the action of the reduced pressure acting on the article in the printing portion.

17. A process as set forth in claim 14 wherein at the transfer portion a reduced pressure is caused to act on the article.

18. A process as set forth in claim 15 wherein the abutment is reciprocated between an operative position in which it extends into the path of movement of an article lying on the printing portion and an inoperative position, in dependence on movement of the holding device.

19. A process as set forth in claim 14 wherein the article on the transfer portion is taken over by a stationary support means disposed downstream of the holding device in the transport direction when the holding device is at least adjacent to its second limit position.

20. A process as set forth in claim 19 wherein at the stationary support means a reduced pressure is caused to act on the article.

21. A process as set forth in claim 20 wherein when the article moves from the transfer portion to the stationary support means the reduced pressure applied by the transfer portion and the reduced pressure applied by the stationary support means are operative simultaneously and the suction effect caused by the reduced pressure at the stationary support means is greater than that at the transfer portion.

22. A process as set forth in claim 1 wherein upstream of the aligning device in the transport direction the presence of an article in the transport path is checked and when an article is present the position and alignment of said article are checked and an improperly disposed article is ejected and in the absence of an article to be printed upon at the holding device a replacement article is moved into a position relative to the printing cylinder in which the print image intended for the absent article is transferred from said transfer means on to the replacement article before ink is again applied to the part of the transfer means bearing the print image intended for the absent article.

23. A process as set forth in claim 1 for an article provided at at least one side with a cavity, wherein when the surface at a side without a cavity is printed upon the wall region of the article defining the cavity therein is supported by a support element which extends into the cavity.

24. A process as set forth in claim 21 wherein first and second articles are respectively transported and printed upon in pairs and synchronously.

25. A process as set forth in claim 24 wherein the articles of each pair are printed upon with different print images.

26. A process as set forth in claim 25 wherein a respective transport path is provided for each article of a pair and wherein one of two sides of a said article is printed upon in the first transport path and the other side of the article is printed upon in the second transport path.

27. A process as set forth in claim 26 wherein each article successively passes through both transport paths thereby to be printed upon on both sides.

28. Apparatus for printing on individual articles which each have an at least substantially flat surface to be printed upon and which are each of a relatively small extent perpendicularly to the substantially flat surface, using at least an offset printing process, comprising: at least one offset printing arrangement having at least first and second plate cylinders, a printing cylinder having a periphery, and at the periphery of the printing cylinder at least one transfer means with at least one transfer surface for an overall print image formed from at least two partial print images; at least first and second transport means arranged in succession in the direction of transport of the articles through the apparatus; at least one holding device for holding the article during a printing operation, the holding device being adapted to be reciprocal between a first position for receiving an article to be printed upon and a second position at a spacing from the first position; an aligning device arranged upstream of the holding device in the transport direction; and a transfer device for the articles adapted to be moved reciprocally between the aligning device and the holding device when disposed in the first receiving position.

29. Apparatus as set forth in claim 28 wherein the aligning device includes a receiving surface for carrying the article, and further comprising an abutment for the article, and at least one pushing means operatively associated with said receiving surface and movable substantially transversely to said transport direction for moving a said article for alignment thereof against said abutment.

30. Apparatus as set forth in claim 29 wherein the at least one pushing means has a central region and first and second ends and at at least one of its ends it has a projection which extends at an obtuse angle relative to the central region, the pushing means being longer at said at least one end than the article to be aligned.

31. Apparatus as set forth in claim 30 wherein at least one of said projections is adapted to be elastically yielding.

32. Apparatus as set forth in claim 31 including first and second parallel article-feed paths wherein said aligning device is adapted for simultaneous alignment of two articles on said paths, and further including a common abutment bar for both said articles and a pushing means at each side of the abutment bar for each of the articles.

33. Apparatus as set forth in claim 29 including a reduced pressure source wherein the receiving surface comprises openings adapted to be connected to the reduced pressure source to hold the article in its aligned position by the suction effect produced in that way by the action of the reduced pressure source.

34. Apparatus as set forth in claim 28 including a reduced pressure source wherein the transfer device includes at least one transfer surface adapted to bear against an article at the aligning device, said transfer surface having openings adapted to be connected to the reduced pressure source, the arrangement being such that the suction effect of said openings holds the article on said transfer surface for transfer of the article from the aligning device in the aligned position to the holding device.

35. Apparatus as set forth in claim 33 wherein the transfer surface is adapted to apply to the article a suction effect which is greater than the suction effect applied to the article by the aligning device.

36. Apparatus as set forth in claim 28 wherein the transfer device comprises a bar reciprocal between the aligning device and the holding device when it is in the article-receiving position.

37. Apparatus as set forth in claim 28 including a reduced pressure source wherein the holding device has at least first and second portions disposed in succession in the transport direction, the first portion is operable to receive the article during the printing operation and has openings adapted to be connected to the reduced pressure source for holding the article, and the second portion is lower than the first portion.

38. Apparatus as set forth in claim 37 wherein the difference in height between the first portion and the second portion is less than the extent of the article perpendicularly to the direction of the said surface to be printed upon.

39. Apparatus as set forth in claim 37 and further including an abutment which is reciprocal between an operative and an inoperative position and which in its operative position projects into the path of movement of a said printed article disposed at the first portion of the holding device, the arrangement being such that in the course of the return movement of the holding device into said first position thereof the article at the holding device is displaced relative to the holding device to said second portion whereby the first portion is freed for receiving an article for a subsequent printing operation.

40. Apparatus as set forth in claim 39 including an abutment means with respect to which the holding device is displaceable, and further including adjoining the first portion of the holding device at its side remote from the aligning device a transfer portion for receiving an article which has already been printed upon and which is displaced from its position at the first portion to the position at the transfer portion by the abutment means engaging the article on the holding device as the holding device is displaced.

41. Apparatus as set forth in claim 28 including a reduced pressure source adapted to hold articles to the aligning device, the holding device and the transfer device, wherein the suction effect produced by the reduced pressure source is continously operative at the aligning device, the transfer device and the holding device.

42. Apparatus as set forth in claim 28 wherein for printing on articles which are provided with at least one cavity the holding device includes a punch mounted reciprocally between an operative position in which it engages into the cavity in the article and supports at least a part of the region defining the cavity and an inoperative position in which it is retracted out of the cavity.

43. Apparatus as set forth in claim 42 including a piston-cylinder means, wherein the punch is carried by the piston of the piston-cylinder means.

44. Apparatus as set forth in claim 43 including a reciprocally arranged main body wherein the holding device and the punch with piston-cylinder means are combined to form a structural unit, and further including fixing means for releasably fixing the structural unit to the reciprocally arranged main body.

45. Apparatus as set forth in claim 28 and further including a common cam disk for producing the movement of the transfer device and the holding device.

46. Apparatus as set forth in claim 39 and further including a common cam disk for producing the movement of the transfer device, the holding device and the abutment.

47. Apparatus as set forth in claim 28 and further including upstream of the aligning device in the transport direction a monitoring means operable to check for the presence of an article in the transport path and also operable when an article is present to check the position and alignment of the article, and ejector means actuable by the monitoring means to eject an improperly disposed article from the transport path.

48. Apparatus as set forth in claim 47 and further including in operative association with the offset printing arrangement a material web for receiving offset print images, and a guide means for guiding the material web, the guide means being arranged movably between a first position in which a portion of said material web guided by the guide means is in contact with the at least one transfer means of the printing cylinder and a second position in which the guide means with the portion of said material guided thereby is at a spacing from said printing cylinder, the position of the guide means being controllable by the monitoring means in dependence on the result of the checking operation thereof in such a way that when an article is absent the print image intended for the absent article is transferred on to the material web by the transfer means before the transfer means carrying said print image is again provided with an application of ink.

49. Apparatus as set forth in claim 28 including first and second transport paths for transporting and printing upon articles in respective pairs, wherein the at least one offset printing arrangement and devices operatively associated therewith are also adapted for operating on articles in pairs.

* * * * *